United States Patent [19]

Miller et al.

[11] Patent Number: 4,457,158

[45] Date of Patent: Jul. 3, 1984

[54] METHOD AND APPARATUS FOR NECKING CAN BODIES

[75] Inventors: Edward C. Miller, Broomfield; John M. Ury, Boulder; Milton S. Hager, Westminster, all of Colo.

[73] Assignee: Ball Corporation, Muncie, Ind.

[21] Appl. No.: 461,782

[22] Filed: Jan. 28, 1983

[51] Int. Cl.[3] ..... B21D 51/26

[52] U.S. Cl. ..... 72/354; 413/1; 413/69

[58] Field of Search ..... 72/354, 394; 413/1, 413/69

[56] References Cited

U.S. PATENT DOCUMENTS

| | | | |
|---|---|---|---|
| 3,088,202 | 5/1963 | Murray | 72/71 |
| 3,771,476 | 11/1973 | Heinle | 72/354 |
| 3,812,696 | 5/1974 | Kneusel | 413/1 |
| 3,845,563 | 11/1974 | Hilgenbrink | 72/354 |
| 4,070,888 | 1/1978 | Gombos | 413/1 |
| 4,392,764 | 7/1983 | Kubis | 72/354 |

*Primary Examiner*—Leon Gilden

*Attorney, Agent, or Firm*—Gilbert E. Alberding

[57] ABSTRACT

Can manufacture, particularly the formation of can necks, is improved by modification of necking tooling to stop the rearward travel of the interior of its two coaxial can-deforming members between which can bodies frequently become jammed. The addition of a stop means to the base of the tooling prevents the concurrent travel of the interior member with the outer member due to the frictional engagement of the can body between the two tooling members. With the interior member stationary, the outer member can be driven from the jammed can.

5 Claims, 2 Drawing Figures

METHOD AND APPARATUS FOR NECKING CAN BODIES

BACKGROUND OF THE INVENTION

This invention relates to an improved method and apparatus for the manufacture of metal cans, and more particularly to improved method and apparatus for necking the open end of a metal can.

Metal cans may be formed in a variety of ways. A common method of forming metal can bodies is by the drawing and ironing process which produces a seamless can body having only one open end. These can bodies are most desirably provided at their open end with a necked-in portion and flange so that their open ends can be sealed by a can top with double seams that do not project outwardly of the can body. In such a can, the external diameter of the can top, including its double seam attachment, is about equal to the external diameter of the can body.

Methods and apparatus for necking-in and flanging can bodies are well known in the art. Included among prior patents relating to necker-flangers and their operation are U.S. Pat. Nos. 3,688,538; 3,754,424; 3,765,351; 3,872,314; 3,782,315; 3,874,209; 3,967,488; 4,070,888; and 4,176,536.

In addition to the methods and apparatus disclosed in the above patents, the open ends of can bodies have been provided with a neck of reduced diameter by the necker-flanger of the Reynolds Aluminum Company which carries their designation NC-8B (shown in FIG. 1). This necking tool has a stationary outer base and reciprocating concentric die and pilot assemblies that are movable longitudinally within the outer base. The reciprocating die member, which is arranged between the outer base and the pilot assembly, carries the necking die surface and is positively driven, for example, by a cam engaging its rear surface. The reciprocating pilot assembly is spring-loaded forwardly from the reciprocating die member. The forward portions of the die member and pilot assembly are intended to enter the open end of the can body and to form the neck of the can.

In operation, a can body to be provided with a neck is positioned opposite the necking tool with the bottom of the can body resting against a supporting surface. The die member is driven forwardly and, through its spring-loaded interconnection with the pilot assembly, drives the pilot assembly forwardly from the stationary base toward the open end of the can. The outer end of the pilot assembly enters the open end of the can in advance of the die member to provide an anvil surface against which the die can work. The forward advance of the pilot assembly is stopped, by the engagement of a homing surface on the stationary base with an outwardly projecting rear portion of the pilot assembly, slightly before the forward portion of the die member engages the open end of the can. As the die member continues to be driven forwardly by the cam, its die-forming surface deforms the open end of the can against the anvil surface of the pilot assembly to provide a necked-in end to the can body.

Upon completion of the formation of the necked-in open end, the reciprocating die member and pilot assembly are driven rearwardly within the stationary base. The metal can body is held stationary against its supporting surface by the application of compressed air from the necking tool. The pilot assembly is provided with a central passageway which is connected with a source of compressed air. Prior to the rearward movement of the die-forming member, air pressure is supplied to the interior of the can body through the central passageway formed in the pilot assembly. The air pressure provides a force on the bottom of the can, tending to move it away from the necking tool, and holds the bottom of the metal can body against its supporting surface as the die and pilot are moved rearwardly. The compressed air is turned off as the pilot assembly clears the open end of the can.

In normal operation, the pilot assembly remains stationary during the first part of this motion because it is spring-loaded forwardly and its outwardly projecting rear portion remains engaged with the homing surface of the stationary base. With the continued rearward movement of the outer die member, the die member at its rear contacts the projecting rear portion of the pilot assembly so that both are driven rearwardly and disengage the open end of the can. When the die member and pilot assembly have completed their rearward movement into the stationary base, the can is free to move to its next stage of formation.

In the above methods and apparatus, however, because of variations in the thickness of metal at the open end of the can and other variations in the prior manufacturing steps, the open end of the can frequently becomes jammed between the closely fitting and concentric die-forming surface of the die member and the interior anvil surface of the pilot assembly. In such situations, the force applied by the spring tending to urge the pilot assembly forwardly from the die member and the force of the ir pressure are not sufficient to overcome the resulting frictional engagement of the die member, the can body, and the pilot assembly. Thus, the die member, the can body, and the pilot assembly become jammed together, and as the die member is driven backwardly by the cam, the pilot assembly and can body also are moved backwardly together, and the air pressure in the can cannot eject the can body from the necking tool. This results in the can body being moved into such an improper position with respect to the remainder of the can-handling system that it is torn apart by other can-handling parts of the system, such as the discharge rails, and a portion of the can body remains in the space between the die member and the pilot assembly, blocking the entry of other can bodies and rendering the necking tool inoperable. In these situations, it is necessary to stop manufacturing, disassemble the necking tool from the machine, and remove from between the pilot assembly and die member the remains of the torn can body. In addition, sometimes the discharge rails and other portions of the machine are damaged and need repair. In the past, stoppages of this kind were frequent, happening as many as several times an hour. Each such stoppage took five to ten minutes to clear.

Such stoppages represent a significant loss of production. Cans are manufactured at very high rates, and can operations like the necking operation occur at a rate up to 1400 cans per minute. Thus, such stoppages represent a loss on the order of 5000 to 10,000 cans per hour of production, and an annual loss of as much as 50,000,000 cans. This significant loss of production was solved with the invention of this application.

SUMMARY OF THE INVENTION

In accordance with the invention, a stop means is fixed to the stationary base member and coacts with the reciprocating pilot assembly to limit the rearward longitudinal travel of the pilot assembly with respect to the base member. With the pilot assembly prevented from moving rearwardly with the die member, only the outer die member is driven rearwardly, and therefore relative movement is provided between the forward portions of the pilot assembly and the die member. The stationary pilot assembly and the air pressure applied to the can tend to maintain the can body stationary and permit the die member to be withdrawn from the can body. The air pressure then is free to eject the can from the necking tool.

The invention therefore includes apparatus for necking-in the open end of the cylindrical side wall of a metal can body and includes, in addition to a stationary base member, a die member longitudinally movable with respect to the base member, and a pilot assembly coaxially situated and longitudinally movable with respect to the die member and adapted to supply air under pressure through a passageway centrally located in the pilot assembly. The pilot assembly includes means, in the form of outwardly projecting surfaces, for coacting with the base and for limiting the longitudinal travel of the pilot, assembly with respect to the base. Biasing means coaxially situated between the die member and the pilot assembly urges the pilot assembly forwardly with respect to the die member. The apparatus includes drive means for moving the die member and pilot assembly forwardly toward the open end of a can body positioned opposite the apparatus and to thereby deform the open end of the can body. The drive means subsequently drives the die member and pilot assembly rearwardly from the open end of the can body so that the can body may be transferred to another work station. The stop means, which is fixed to the base, coacts with the coacting means of the pilot assembly to limit the rearward travel of the pilot assembly with respect to the base, thereby enhancing the ejection of the can body from the apparatus.

In the method of the invention, after the open end of a thin metal can body is provided with a necked-in portion, the die member is moved rearwardly away from the can body, and compressed air is applied to the inside of the can body through the pilot assembly.

If a can body is jammed between the die member and pilot assembly and the pilot assembly begins to move rearwardly with the movement of the die member, the rearward movement of the pilot assembly is stopped by engagement of its coacting means with the stop means of the base while the rearward movement of the die member continues, and the continued rearward movement of the die member disengages it from the open end of the can so that the can is ejected by the continued movement of the die member and the application of the compressed air.

The invention and its features are more particularly shown by the following drawings and description.

DETAILED DESCRIPTION OF THE PREFERRED EMBODIMENTS

Figure 1:
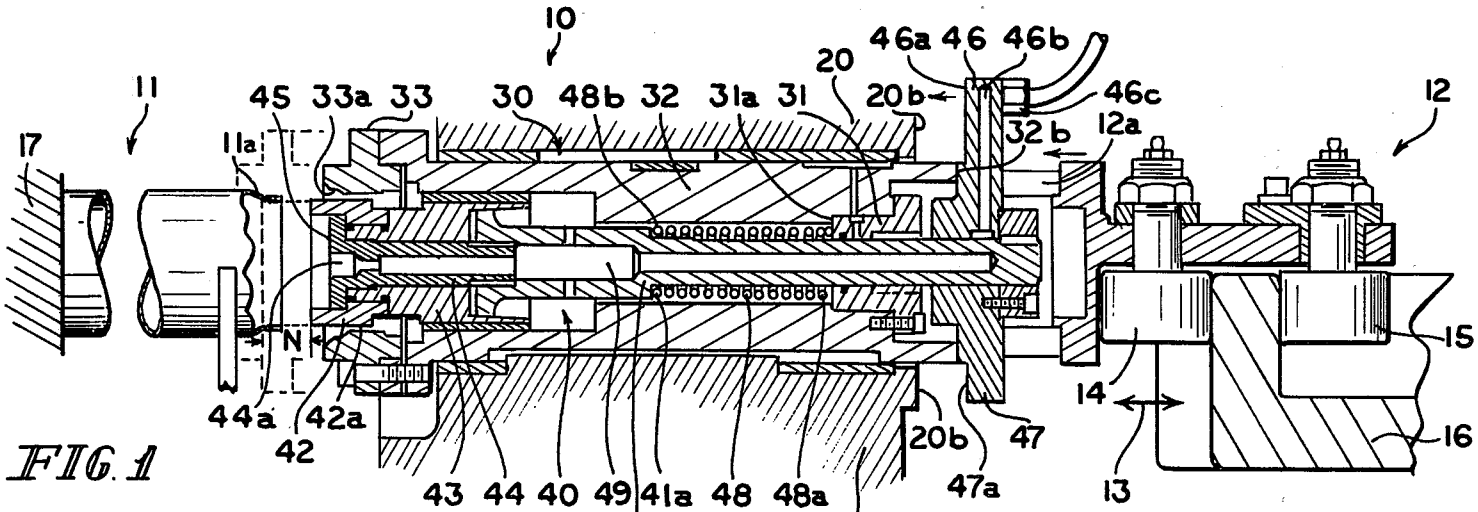
FIG. 1 is a cross-sectional view through the center of the apparatus prior to our invention.

The necking apparatus, indicated generally at 10, in its operation will neck-in or reduce the diameter of a can body 11 positioned opposite its forward end 10*a*. The necking apparatus is driven from its rear by driving means 12. In addition to the driving means 12, which may or may not be separate from the remainder of the necking apparatus, the necking apparatus consists of basically three parts: the stationary base or barrel portion 20, a die member 30 coaxially carried within the base 20 and reciprocatable longitudinally within the base 20, and a pilot assembly 40 coaxially carried within the die member 30 and reciprocatable longitudinally with respect to the die member 30 and the base 20. Reciprocatable means that the members may be reciprocated back and forth along their central axis.

The die member 30 can comprise a multiplicity of elements including, for example, as shown in the drawings, a rear element 31 with a spring-engaging surface 31*a*, a central element 32, and a forward element 33 with a die-forming surface 33*a*. The pilot assembly 40 may also comprise a multiplicity of elements including a central element 41, forward elements 42, 43, and 44, and outwardly projecting rear portions 46 and 47. The pilot assembly 40 is biased forwardly within the die member 30 by a spring or other biasing means 48, with one end 48*a* of the spring resting upon a spring-engaging surface 31*a* of the rear element 31 of die member 30, and the other end 48*b* of the spring engagig a spring-driven surface 41*a* of the central element 41 of a pilot assembly 40. A passageway 49 begins adjacent the rear of the pilot assembly 40 and terminates in an opening 44*a* in the face 45 of the pilot assembly.

Driving means 12 is fastened or connected to die member 30, for example, by portion 12*a* extending between the driving means 12 and the die member 30. The base, or the stationary barrel, 20 may be fastened to a supporting structure by an convenient fastening means (not shown).

Die member 30 is supported by stationary barrel 20 in a sliding piston-cylinder-type engagement, and die member 30 may be reciprocated longitudinally along the central axis of the necking apparatus with respect to base 20 by motion imparted to the driving means 12 as, for example, indicated by the arrows 13 of FIG. 1. The motion imparted die member 30 by driving means 12 is transmitted to the pilot assembly 40 through spring 48. As shown in FIG. 1, the forward motion of die member 30 and its spring-engaging surface 31*a* acts on spring 48 and is transmitted by spring 48 to the spring-driven surface 41*a* of the pilot assembly 40, thereby moving the pilot assembly forwardly with the die member.

The pilot assembly, however, has at its rear end a coacting means in the form of a pair of outwardly projecting portions 46 and 47. As shown in FIG. 1, the coacting means of outwardly projecting portions 46 and 47 will engage homing surface 20*b* at their forward faces 46*a* and 47*a*, respectively, as the pilot assembly is moved forwardly, thereby limiting the travel of the pilot assembly 40 with respect to the base 20. As the die member 30 is moved still forwardly by the driving means 12, its motion compresses spring 48 between spring-engaging surface 31*a* and spring-driven surface 41*a*.

As driving means 12 moves rearwardly, pilot assembly 40 is held forwardly with the forward surfaces 46*a* and 47*a*, respectively, of its outwardly projecting portions 46 and 47 held against the homing surface 20*b* at the rear of base 20 by the force of the compressed spring 48. As die member 30 moves further, its rear pilot-driving surface 32*b* engages portions of the outwardly projecting surfaces 46 and 47 of the pilot assembly 40, and the die member 30 and pilot assembly 40 are driven rearwardly in unison by the driving means 12.

As shown in FIG. 1, the outwardly projecting portion 46 may be provided with a passageway portion 46*b* in communication with the rear of passage 49 of the pilot assembly. Means 46*c* may be provided to connect the passageway 49 with the source of compressed gas (not shown) which, in most factory operations, is compressed air.

The necking apparatus 10 may be adapted to be mounted on a stationary support with the driving means 12 having a pair of rollers 14 and 15 that are driven from a cam 16 that passes between them. Necking apparatus 10 may also be moved and driven as it is moved by a stationary cam 16 passing between rollers 14 and 15.

In operation, can 11 is positioned opposite the face 45 of the pilot assembly 40 of the necking apparatus 10. With the can 11 in position, the driving means 12 is moved by the cam 16 in the direction of the can. The die member 30 is urged in the direction of can 11 within the base 20. The forward movement of the die member 30 and its spring-engaging surface 31*a* moves the pilot assembly 40 forwardly so that its face 45 enters the open end of the can 11. After the pilot assembly 40 has traveled into the open end of the can a distance N (see the phantom lines of FIG. 1), the forward faces 46*a* and 47*a* of the outwardly projecting coacting means 46 and 47, respectively, at the rear of the pilot assembly 40, engage the rear homing surface 20*b* of the base 20, thereby stopping the forward travel of the pilot assembly 40 and positioning its outward cylindrical anvil faces 42*a* within the open end of the can body, as shown in phantom lines in FIG. 1. At this point in its forward travel, the die surface 33*a* at the forward end of die member 30 has not yet begun its deformation of the can body 11.

As driving means 12 moves further to the left as shown in FIG. 1, the die surface 33*a* deforms the open end of the can body against the coaxial anvil surfaces 42*a* providing a necked-in portion 11*a* of the can body.

At this point, a control valve (not shown) may be actuated by either the movement of the cam 16 with respect to the necking apparatus 10 or by movement of the necking apparatus 10 with respect to the cam 16. Compressed air is applied to passageway 49 in the pilot assembly 40 through means 46*c*, and is released through opening 44*a* in face 45 of the pilot assembly 40 and pressurizes can body 11 and tends, through the pressure and force acting on the base of the can, to force the can away from the necking apparatus 10. The can, however, is held stationary with respect to the apparatus by a backing surface 17.

Through the action of cam 16, driving means 12 is then moved to the right in FIG. 1 with respect to the stationary base 20. Die member 30 begins to move to the right in FIG. 1; but in normal operation, pilot assembly 40 continues to be stationary because of the force imparted to pilot assembly 40 by the compression of spring 48. When the rear pilot-driving surface 32*b* of die member 30 engages the outwardly extending surfaces 46 and 47, respectively, of the pilot assembly 40, the pilot assembly 40 is also moved to the right by the further motion imparted to the die member 30 by cam 16. The force of the compressed air acting upon the bottom of can 11 holds can 11 against the supporting surface 17 as the die surface 33*a* and anvil surface 42*a* are withdrawn from the open end of the can. Thus, the compressed air tends to eject the can in normal operation from the necking apparatus. When the can 11 is free of the necking apparatus 10, it may be moved to the next station.

Unfortunately, variations in the prior steps of formation of can 11 or variation in the metal thickness or metal characteristics or a build-up of metal deposits on the surface 33*a* and 42*a* of the necking apparatus can result in cans 11 being jammed within surfaces 33*a* and 42*a* of the necking apparatus. As a result of the open end 11*a* of the can being trapped within the die surface 33*a* and anvil surface 42*a*, spring 48 may not provide sufficient force to hold the pilot assembly 40 forwardly as the die member 30 beings its rearward movement from the can. In the event of such jams, the compressed air frequently cannot provide sufficient force to eject the jammed can 11 from within surfaces 33*a* and 42*a* of the necking apparatus. In such situations, the can 11 remains trapped within the reciprocating members 30 and 40 of the necking apparatus and is moved to the right with members 30 and 40 by cam 16 and its action on the driving means 12. As the can-forming machinery tries to move can 11 to a new formation step, can 11 becomes mangled by the can-handling machinery, and it is not uncommon that the neck portion 11*a* is torn off and remains between the surfaces 33*a* and 42*a* of the necking apparatus, preventing the necking apparatus from acting upon any subsequent can body. In addition, the mangled portion of such a jammed can may block further indexing in the can-making machinery, thereby interrupting production and forcing disassembly of the can-making machinery, removal and disassembly of the necking apparatus 10 to clear the annular opening between the die surface 33 and the coaxial anvil surface 48.

With the apparatus shown in FIG. 1, such jam-ups occurred frequently, and disassembly of the apparatus to clear the machinery could take up to ten to fifteen minutes.

Figure 2:
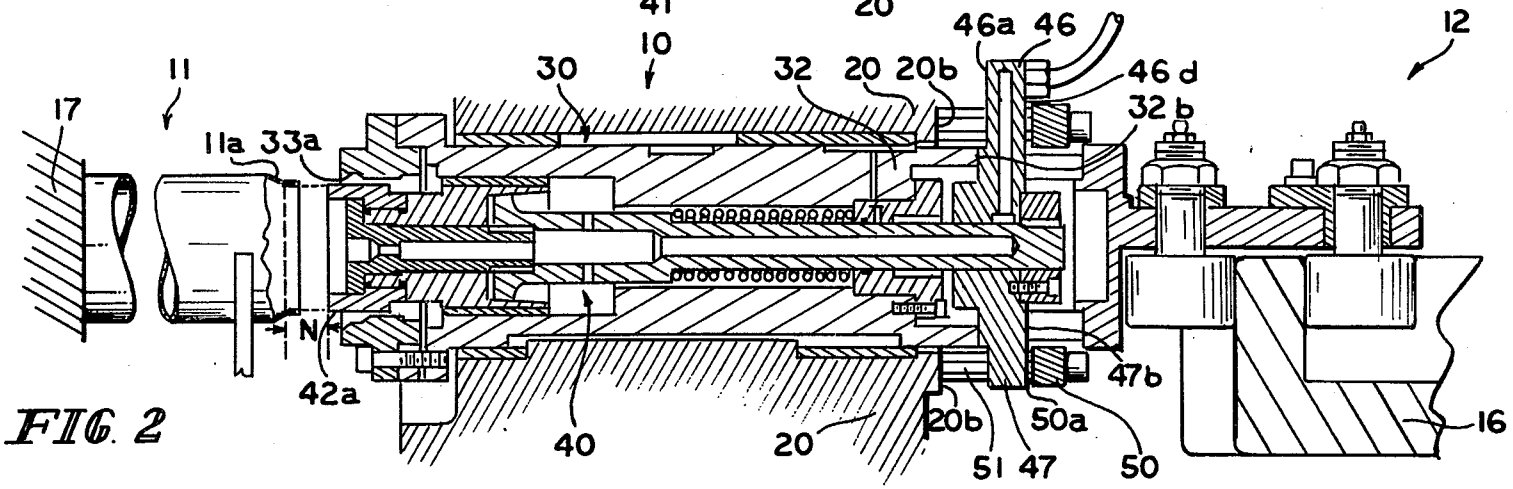
FIG. 2 is a cross-sectional view of the apparatus of our invention.

In accordance with the invention as shown in FIG. 2, such jam-ups have been virtually eliminated by an improvement comprising a stop means 50, in the form of an annular ring, supported from the stationary base 20 by a plurality of stand-offs 51. The stop means 50 is supported by the stand-offs 51 rearwardly of the coacting means of the pilot assembly 40; i.e., the outwardly projecting surfaces 46 and 47. The forwardmost surface 50*a* of the annular ring 50 is positioned by the dimensions of the annular ring 50 to engage the rear surface 46*d*, 47*b*, respectively. The motion of pilot assembly 40 is thereby limited in the invention by its coacting means, as shown in FIG. 2, to a forward travel until its surfaces 46*a* and 47*a* engage homing surfaces 20*b* of the base 20 and rearward travel until the rear surfaces 46*d* and 47*b*, respectively, engage the forward surface 50*a* of the stop means 50.

This addition of the stop means is easily achieved and relatively simple, and its consequences are great, virtually eliminating jam-ups as will be described.

Except for the addition of stop means 50 including its stand-offs 51, the necking apparatus 10 of FIG. 2 and the necking apparatus of FIG. 1 are alike. As cam 16 drives driving means 12 forwardly, die member 30 and pilot assembly 40 are driven forwardly exactly as described above so that the pilot assembly 40 and its anvil surface 42a are moved into the can a distance N before the die surfaces 33a of die elements 30 begin their deformation of the open end of can 11. As cam 16 continues to drive die member 30 to the left as shown in FIG. 2, die surface 33a deforms the open end of the can against the coaxial anvil surface 42a, providing a necked-in portion 11a of the can. As before, compressed air is applied to the interior of the can upon the completion of the neck-forming operation to hold the can 11 against base 17 as die members 30 and pilot assembly 40 are extracted from the open end of the can.

The extraction of die members 30 and pilot assembly 40 from the can, however, follow a different sequence from the apparatus of FIG. 1 and achieve a strikingly different result with the addition of stop means 50.

As cam 16 drives the driving means 12 to the right in FIG. 2 with respect to the stationary base 20, it drives die member 30 likewise to the right away from the can-supporting surface 17. In the event the open end 11a of the can remains jammed between the die surface 33a and the anvil surface 42a to such a degree that pilot assembly 40 moves rearwardly with die element 30, the movement of the pilot assembly 40 will be intercepted and blocked by stop means 50 at a point about its original or rest position. Further movement of the driving means 12 and the die member 30 will result in relative movement between the die surface 33a and the anvil surface 42a as the die member 30 continues to move to the right. Compressed air remains applied to the interior of the can body later in the process than with the apparatus of FIG. 1. As die surface 33a is withdrawn from the can body 11, the action of the compressed air will eject the can body 11 from the necking apparatus, thereby clearing the jam from the apparatus.

Stop means 50 is supported from base 20 by stand-offs 51 a distance which will permit die member 30 sufficient rearward travel that the rearward movement of rear pilot driving surface 32b is accommodated without interference when a can is being necked normally; i.e., when an incipient jamming condition does not occur.

The invention thus provides a method and apparatus for imposing relative motion between the die-forming surface and its corresponding coaxial anvil surface of the pilot assembly during withdrawal of the necking tool from a can body. The invention permits the die-forming surface to be withdrawn from the open end of the can notwithstanding frictional forces imposed by a can portion that may be jammed between the die member and pilot assembly and permits compressed air imposed on the can body through the pilot assembly to expel the can from the apparatus.

We claim:

1. In an apparatus for necking an open can portion of a cylindrical side wall of a sheet metal can body, including a base member, a die member longitudinally reciprocatable with respect to said base member, a pilot assembly coaxially situated and longitudinally reciprocatable with respect to said die member, the pilot assembly including means coacting with the base to limit the forward travel of the pilot assembly with respect to the base, and biasing means for biasing the pilot assembly forwardly with respect to the die member, the improvement comprising stop means fixed to the base and coacting with said pilot assembly coacting means to limit the rearward travel of the pilot assembly with respect to the die member and base.

2. The apparatus of claim 1 in which the stop means is an annular ring that is supported from the rear of the base member by a plurality of stand-offs, and the annular ring surrounds the rear of the pilot assembly, and the pilot assembly coacting means is a pair of outwardly projecting surfaces at the rear of the base member that extend outwardly between the base member and the annular ring.

3. An apparatus for forming an open end portion of a cylindrical side wall of a sheet metal can body comprising a base member, a die member longitudinally reciprocatable with respect to said base member, a pilot assembly coaxially situated and longitudinally reciprocatable with respect to said die member and adapted to supply air under pressure centrally through the pilot assembly, the pilot assembly including means for contacting a surface of the base to limit the longitudinal travel of the pilot assembly with respect to the base, biasing means for biasing the pilot assembly forwardly with respect to the die member, means to drive the die member and pilot assembly forwardly toward the open end of the can body and to form the cylindrical side wall at the open end of the can and to subsequently drive the die member and pilot assembly rearwardly from the open end of the can body so that the formed can may be transferred to another work station, and stop means fixed to the base coacting with the contacting means of the pilot assembly for limiting the rearward travel of the pilot with respect to the base.

4. The apparatus of claim 3 in which the stop means is an annular ring that is supported from the rear of the base member by a plurality of stand-offs, and the annular ring surrounds the rear of the pilot assembly, and the pilot assembly contacting means is a pair of outwardly projecting surfaces at the rear of the base member that extend between the base member and the annular ring.

5. A method of necking the side wall forming an open end of a thin metal can body with a necking apparatus having a die member and a coaxially situated pilot that engage and form a neck in the can body comprising positioning the can body with its open end facing the necking apparatus simultaneously driving the die member and the coaxially situated pilot assembly longitudinally along the axis of the can body so that the pilot assembly enters the open end of the can and the die member engages the side wall, stopping the movement of the pilot assembly after it has entered the can while continuing the movement of the die member to form a neck at the open end of the can body between forward surfaces of die member and the pilot assembly, beginning removal of the die member and of the pilot assembly and applying gas under pressure from the necking apparatus to the can body while driving the die member rearwardly, stopping any rearward movement of the pilot assembly, and continuing the rearward movement of the die member so that any can remaining between the die member and pilot assembly is removed by the continued motion of the die member and the application of gas under pressure.

* * * * *